US009098020B2

(12) United States Patent
Aiba

(10) Patent No.: US 9,098,020 B2
(45) Date of Patent: Aug. 4, 2015

(54) IMAGE FORMING APPARATUS WITH CLEANING CURRENT CONTROL

(75) Inventor: Shozo Aiba, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 13/593,791

(22) Filed: Aug. 24, 2012

(65) Prior Publication Data

US 2013/0051832 A1 Feb. 28, 2013

(30) Foreign Application Priority Data

Aug. 26, 2011 (JP) ..... 2011-184702

(51) Int. Cl.
*G03G 15/00* (2006.01)
*G03G 15/16* (2006.01)
*G03G 15/01* (2006.01)

(52) U.S. Cl.
CPC ..... *G03G 15/168* (2013.01); *G03G 15/0189* (2013.01); *G03G 2215/0129* (2013.01)

(58) Field of Classification Search
CPC ..... G03G 15/0189; G03G 15/168; G03G 15/166; G03G 2215/1652; G03G 2215/1657; G03G 2215/0026; G03G 2215/0042
See application file for complete search history.

(56) References Cited

U.S. PATENT DOCUMENTS

| | | | | |
|---|---|---|---|---|
| 6,341,205 | B1 * | 1/2002 | Yoshino et al. | 399/101 |
| 6,567,625 | B1 * | 5/2003 | Tatematsu et al. | 399/75 |
| 6,990,300 | B2 * | 1/2006 | Saito et al. | 399/101 |
| 2004/0131373 | A1 | 7/2004 | Saito et al. | |

FOREIGN PATENT DOCUMENTS

| | | |
|---|---|---|
| JP | 2004-145297 A | 5/2004 |
| JP | 2005-173630 A | 6/2005 |

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus includes transferring current to the transfer portion; a cleaning blade, provided downstream of a transfer portion and upstream of an image forming station with respect to a rotational moving direction of an intermediary transfer member, for removing toner from the intermediary transfer member; an executing portion for executing an operation in a cleaning mode for removing the toner by the cleaning blade, in which a cleaning current is applied to a transfer portion in a direction opposite to that of an image transferring current to shift the toner from the transfer roller onto the intermediary transfer member; and a controller for setting the cleaning current, in which the set cleaning current is lower when a cumulative number of fed recording materials from the execution of the previous cleaning mode is larger.

4 Claims, 7 Drawing Sheets

IMAGE FORMING APPARATUS WITH CLEANING CURRENT CONTROL

FIELD OF THE INVENTION AND RELATED ART

The present invention relates to an image forming apparatus operable in the cleaning mode in which toner is electrostatically transferred from the secondary transfer roller of the apparatus onto the intermediary transfer belt of the apparatus, and is recovered by the cleaning blade of the apparatus. More specifically, it relates to how the voltage to be applied to the secondary transfer roller of the apparatus is to be controlled in order not to reduce the life of the cleaning blade of the apparatus.

An image forming apparatus is structured so that its transfer roller is placed in contact with its intermediary transfer member to form its transfer station; a toner image formed in its image forming station is transferred onto the intermediary transfer member and conveyed to the transfer station; and voltage is applied to the transfer station to transfer the toner image onto a sheet of recording medium from the intermediary transfer member, has been widely in use. In the case of an image forming apparatus structured so that a transfer roller is placed in contact with the intermediary transfer member, a minute amount of toner adheres to the transfer roller each time an image is formed. Thus, as the image forming apparatus increases in the cumulative number of images it forms, the transfer roller is gradually soiled by the toner. If this toner having adhered to the transfer roller is left unattended, it adheres to the back surface of a sheet of recording medium. Thus, as the sheet of recording medium is put through a fixing process, it becomes fixed to the back surface of the sheet of recording medium. In other words, if the toner having adhered to the transfer roller is left unattended, an image forming apparatus is likely to output a defective print, that is, a print having a back side contaminated with toner.

Thus, Japanese Laid-open Patent Application 2005-173630 discloses one of the solutions to the above described problem. According to this patent application, an image forming apparatus is operated in the cleaning mode in which its transfer roller is cleaned, as the cumulative number of prints outputted by the apparatus reaches a preset value, or immediately after a toner image for controlling an image forming apparatus, or a lubricatory toner belt, which are not transferred onto recording medium is transferred onto the intermediary transfer member. In the cleaning mode, such voltage that is the same in polarity as the voltage to be applied to the transfer roller during a normal secondary image transfer process, and such voltage that is opposite from the voltage to be applied to the transfer roller during a normal secondary transfer process, are alternately applied to the transfer roller to make the transfer roller expel the toner having adhered to the transfer roller, onto the intermediary transfer member. The expelled toner is recovered by the cleaning blade which is on the downstream side of the secondary transfer station in terms of the moving direction of the intermediary transfer member.

Japanese Laid-open Patent Application 2004-145297 related to an image forming apparatus of the so-called tandem type having a cleaning blade as its belt cleaning means discloses another solution to the above described problem. According to this patent application, each time a job in which a substantial number of sheets of recording medium are continuously conveyed is ended, such voltage that is opposite in polarity from the voltage to be applied to the transfer roller during a normal secondary transfer process is applied to the transfer roller.

It has been discovered that if an image forming apparatus is repeatedly operated in the cleaning mode, specific sections of the intermediary transfer belt are likely to fail to be satisfactorily cleaned. Thus, the inventors of the present invention disassembled an image forming apparatus which failed to satisfactorily clean its intermediary transfer belt, and inspected the cleaning blade for cleaning the intermediary transfer belt. The inspection confirmed that certain portions of the cleaning blade had been reduced in cleaning performance because a substantial amount of paper dust had adhered to the portions of the cleaning blade, which correspond in position to the portions of the intermediary transfer belt between the image bearing area of the intermediary transfer belt and the out-of-image-bearing-area of the intermediary transfer belt, as will be described.

Further studies revealed that immediately after the voltage which is opposite in polarity from the voltage to be applied during a normal secondary transfer process is applied to the transfer roller in the transfer roller cleaning mode, a large amount of paper dust transfers, along with toner, from the secondary transfer roller onto the intermediary transfer belt.

SUMMARY OF THE INVENTION

Thus, an object of the present invention is to provide an image forming apparatus which can operate in the transfer roller cleaning mode to ensure that the back side of a sheet of recording medium is not soiled by the toner from the transfer roller, while preventing the cleaning blade from reducing in cleaning performance and extending the interval with which the cleaning blade has to be replaced.

According to an aspect of the present invention, there is provided an image forming apparatus comprising a rotatable intermediary transfer member for carrying a toner image; an image forming station for forming a toner image on said intermediary transfer member; a transfer roller urged toward said intermediary transfer member to form a transfer portion; a feeding portion for feeding a recording material to the transfer portion; a voltage source for transferring the toner image from said intermediary transfer member onto the recording material fed from said feeding portion by applying a transferring current to said transfer portion; a cleaning blade, provided downstream of said transfer portion and upstream of said image forming station with respect to a rotational moving direction of said intermediary transfer member, for removing toner deposited on said intermediary transfer member; an executing portion for executing, when the recording material is not present in the transfer portion, an operation in a cleaning mode for removing the toner by said cleaning blade, in which a cleaning current is applied to said transfer portion in a direction opposite to that of the transferring current to shift the toner deposited on said transfer roller onto said intermediary transfer member; and a controller for setting the cleaning current, in which the set cleaning current at the time when a cumulative number of fed recording materials from the execution of the previous cleaning mode is a first number is lower than the set cleaning current at this time when the cumulative number is a second number which is smaller than the first number.

According the present invention, when there is a possibility that a substantial amount of paper dust will transfer onto the intermediary transfer member, the transfer current which is opposite in direction from the transfer current which is to be applied when there is not a possibility that a substantial amount of paper dust will transfer onto the intermediary transfer member, is reduced so that the paper dust can be separated from the intermediary transfer belt and recovered without damaging the cleaning blade.

In other words, the present invention can clean the transfer roller while preventing the problem that certain sections of the cleaning blade are reduced in cleaning performance. That is, the present invention can extend the cleaning blade replacement interval while ensuring that a sheet of recording medium is not contaminated with toner on its back surface.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention are described in detail with reference to the appended drawings. However, the embodiments are not intended to limit the present invention in terms of the structure of an image forming apparatus. That is, the present invention is applicable to any image forming apparatus, regardless of whether the image forming apparatus is monochromatic or multicolor, of single drum or multi-drum type, and also, regardless of the charging method, exposing method, and transferring method, as long as the apparatus is structured so that the amount by which transfer current which is to be flowed during the initial stage of the cleaning mode and is different in direction from the transfer current which is to be flowed during a normal secondary transfer process can be optionally set. In the following description of the embodiments of the present invention, only the portions of the image forming apparatus, which are essential to the formation, transfer, and fixation of a toner image, are described. However, the present invention is also applicable to various printing machines, facsimile machines, multifunction machines, and the like, which are combinations of an image forming apparatus such as those in the following embodiments of the present invention, and various additional devices, equipments, cases, etc.

That is, the present invention is applicable to any image forming apparatus as long as the apparatus is designed so that a toner image is transferred from its intermediary transferring member onto a sheet of recording medium with the use of its transfer roller, and the toner remaining on the intermediary transferring member after the secondary transfer is recovered by its cleaning blade. In other words, the present invention is applicable to any image forming apparatus, regardless of the type of its intermediary transferring member, and image formation method.

<Image Forming Apparatus>

Figure 1:
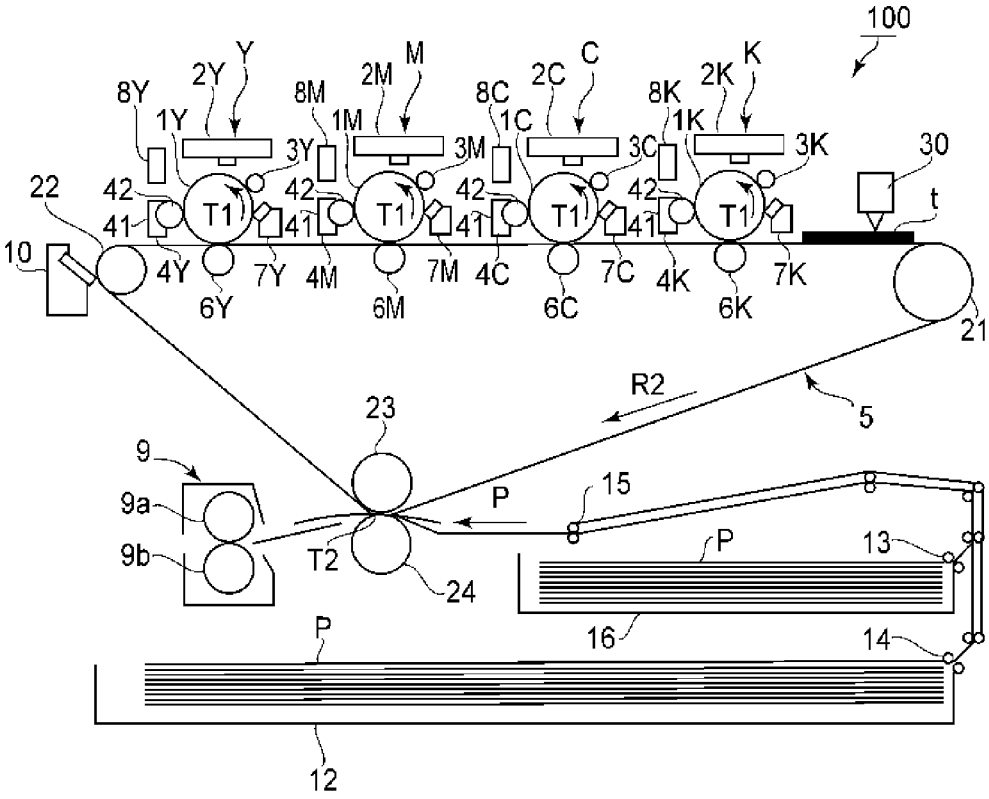
FIG. 1 is a drawing for describing the structure of a typical image forming apparatus to which the present invention is applicable.

FIG. 1 is a drawing for describing the structure of a typical image forming apparatus to which the present invention is applicable. Generally speaking, color image forming apparatuses can be classified as an apparatuses of the single-drum type, or tandem type. In recent years, however, it has begun to be required that the speed at which a full-color image is formed is as fast as the speed at which a monochromatic image is formed. Therefore, the tandem type is becoming the mainstream type.

image forming apparatus of the single-drum type has a single drum, and multiple developing devices which are different in the color in which they develop an image. In operation, it forms multiple monochromatic toner images, different in color, on the photosensitive drum with the use of the multiple developing devices, and transfers in layers the toner images onto its intermediary transfer belt. Then, it transfers together the layered toner images from the intermediary transfer belt, onto a sheet of recording medium (secondary transfer). Since the number of the photosensitive drums which the image forming apparatus of the single-drum type has is only one, an image forming apparatus of the single-drum type can be made substantially smaller in size and lower in cost than an image forming apparatus of the tandem type. However, when it is used for the formation of a full-color image, its single photosensitive drum has to be used multiple times to form multiple monochromatic toner images, different in color. Therefore, it is lower in productivity than an image forming apparatus of the tandem type.

In comparison, an image forming apparatus of the tandem type has multiple photosensitive drums accompanied by their own developing device. In operation, it develops multiple monochromatic toner images, different in color, on the multiple photosensitive drums, one for one, and transfers in layers the multiple toner images onto its intermediary transfer belt. Then, it transfers together the multiple toner images from the intermediary transfer belt, onto a sheet of recording medium. Thus, it is larger in size and higher in cost than an image forming apparatus of the single-drum type, but is higher in productivity than an image forming apparatus of the single-drum type.

Referring to FIG. 1, the image forming apparatus 100 is a full-color printer of the tandem type, and also, of the intermediary transfer type, having therefore an intermediary transfer belt 5, and image formation stations Y, M, C, and K. The image formation stations Y, M, C, and K are aligned in tandem, and form four monochromatic toner images, different in color, with the use of their own toner image forming means, and make the intermediary transfer belt, i.e., an intermediary transfer member formed of a resinous substance, bear in layers the four monochromatic toner images.

In the image formation station Y, a yellow toner image is formed on the photosensitive drum 1Y, and is transferred onto the intermediary transfer belt 5. In the image formation station M, a magenta toner image is formed on the photosensitive drum 1M, and is transferred onto the intermediary transfer belt 5. In the image formation stations C and K, cyan and black toner images are formed on the photosensitive drums 1C and 1K, respectively, and are transferred onto the intermediary transfer belt 5.

After the transfer of the four monochromatic toner images, different in color, onto the intermediary transfer belt 5, the toner images are conveyed to the secondary transfer station T2, in which they are transferred together (secondary transfer) onto a sheet P of recording medium. After the secondary transfer of the toner images onto the sheet P of recording medium, the sheet P is subjected to heat and pressure by the fixing device 9 so that the toner images become permanently fixed to the surface of the sheet P. After the fixation of the toner images, the sheet P is discharged from the main assembly of the image forming apparatus.

<Image Formation Station>

The image formation stations Y, M, C, and K are practically the same in structure, although they are different in the color (yellow, magenta, cyan, and black) of the toner used by their developing devices 4Y, 4M, 4C, and 4K. Hereafter, therefore, only the image formation station Y is described. The description of the image formation stations Y, M, C, and K is the same as that of the image formation station Y except for the referential codes M, C, and K which indicate the color of the image each image formation station forms.

The image formation station Y comprises a photosensitive drum 1Y, a charge roller 3Y, an exposing device 2Y, a developing device 4Y, a transfer roller 6Y, and a drum cleaning device 7Y. The charge roller 3Y, exposing device 2Y, developing device 4Y, transfer roller 6Y, and drum cleaning device 7Y are in the adjacencies of the peripheral surface of the photosensitive drum 1Y. The photosensitive drum 1Y rotates at a preset process speed.

The charge roller 3Y is rotated while being kept in contact with the photosensitive drum 1Y. As it is rotated, oscillatory voltage, which is a combination of DC and AC voltages, is applied thereto. Thus, the peripheral surface of the photosensitive drum 1Y is uniformly and negatively charged. The exposing device 2Y writes an electrostatic image of the image to be formed, on the uniformly charged portion of the peripheral surface of the photosensitive drum 1Y. More concretely, it scans the uniformly charged portion of the peripheral surface of the photosensitive drum 1Y with a beam of laser light it outputs while modulating (turning on or off) the beam of laser light with the image formation data for a yellow monochromatic image, that is, one of the monochromatic images obtained by separating the original image into four monochromatic images, different in color, of which the original image is made of, and deflecting the beam with its rotational mirror.

The developing device 4Y develops the electrostatic image on the photosensitive drum 1Y, into a visible image, that is, an image formed of toner, by making its development sleeve 42 bear the two-component developer which is made up of toner and carrier and is being circularly moved in its developer container 41. The toner supply container 8Y contains the toner which is to be delivered to the developing device 4Y to replenish the developing device 4Y with the toner as the toner in the developing device 4Y is consumed for development.

The transfer roller 6Y is placed in contact with the inward surface of the intermediary transfer belt 5, forming, between the photosensitive drum 1Y and intermediary transfer belt 5, a transfer station T1, in which the toner image is transferred onto the intermediary transfer belt 5. In order to transfer the toner image on the photosensitive drum 1Y onto the intermediary transfer belt 5 with the use of electrical force and physical pressure, the transfer roller 6Y is supported by its lengthwise ends, by a pair of pressure application mechanisms, one for one, which apply pressure to the transfer roller 6Y. To the transfer roller 6Y, a preset positive DC voltage is applied. As the DC voltage is applied to the transfer roller 6Y, the toner image on the peripheral surface of the photosensitive drum 1Y, which is negatively charged, is transferred (primary transfer) onto the portion of the intermediary transfer belt 5, which is moving through the transfer station T1.

The drum cleaning device 7Y recovers the primary transfer residual toner, that is, the toner which failed to be transferred onto the intermediary transfer belt 5 from the photosensitive drum 1Y, and therefore, is remaining adhered to the peripheral surface of the photosensitive drum 1Y. More concretely, the drum cleaning device 7Y scrapes the transfer residual toner away from the peripheral surface of the photosensitive drum 1Y by placing its cleaning blade in contact with the peripheral surface of the photosensitive drum 1Y, collecting the removed transfer residual toner by its scooping sheet, and delivering to an unshown screw. The recovered transfer residual toner is stored in a waste toner container which is in the front portion of the main assembly of the image forming apparatus 100.

The cleaning blade is formed of urethane rubber, and is 1~2 mm in thickness. The scooping sheet is formed of a sheet of polyethylene terephthalate, which is 20~50 μm in thickness. It is for recovering the transfer residual toner to prevent the problem that as the transfer residual toner is scraped away from the peripheral surface of the photosensitive drum 1Y, it temporarily adheres to the cleaning blade edge, agglomerates, and then, falls. Thus, the scooping sheet is placed in contact with the photosensitive drum 1Y in such an attitude that its scooping edge is on the downstream side of its base, in terms of the rotational direction of the photosensitive drum 1Y.

<Photosensitive Drum>

The photosensitive drum 1Y is desired to be an organic photosensitive member, the surface layer of which is $10^9$~$10^{14}$ [Ω·cm] in volume resistivity, or a photosensitive member formed of amorphous silicone, so that it can be charged by charge injection, which does not generate ozone, and is smaller in the amount of power consumption than the other methods for charging the photosensitive drum 1Y, and also, so that it is superior in terms of chargeability than a photosensitive member of the different type.

The photosensitive drum 1Y is a negatively chargeable organic photosensitive member, and is made up of a cylindrical substrate, and a photosensitive layer covering the peripheral surface of the substrate. The photosensitive layer is formed by coating the peripheral surface of the cylindrical substrate with OPC (organic optical semiconductor), which is ordinarily used as the material for the photosensitive layer. More concretely, the substrate is an aluminum drum, which is 30 mm in diameter. The photosensitive layer is formed of first to fifth sub-layers coated in layers, counting from the substrate side. The first sub-layer is an undercoat layer. The second sub-layer is for preventing the injection of positive charge. The third sub-layer is a charge generation layer. The fourth sub-layer is a charge transfer layer. The fifth sub-layer is a charge injection layer.

The first sub-layer is for covering the defects of the peripheral surface of the aluminum substrate. It is an electrically conductive layer, and is 20 μm in thickness. The second sub-layer plays a role of preventing the positive charge injected from the substrate, from cancelling the negative charge given to the peripheral surface of the photosensitive drum 1Y. It is made of a mixture of Amilan resin and methoxymethyl-Nylon, and is roughly $1\times10^6$ [Ω·cm] in volume resistivity. It is medium in electrical resistance, and 1 μm in thickness.

The third sub-layer is formed of a substance made by dispersing diazo pigment in resin, and is roughly 0.3 μm in thickness. It generates charge couples made up of positive and negative charges as it is exposed to light. The fourth sub-layer is formed of a substance made by dispersing hydrazone in polycarbonate resin. It is a semiconductor layer of P type. Thus, the negative charge given to the peripheral surface of the photosensitive drum 1Y cannot transfer through the fourth sub-layer; only the positive charge generated in the charge generation layer is allowed to transfer to the peripheral surface of the photosensitive drum 1.

The fifth sub-layer is formed of a substance made by dispersing microscopic particles of $SnO^2$ in dielectric resin as binder. It is formed by coating the substance on the fourth sub-layer. More concretely, dielectric resin was doped with antimony, which is a transparent and dielectric filler, to be reduced in electrical resistance (made electrically conductive). Then, $SnO^2$ particles which are 0.03 μm in diameter were dispersed in the resin so that the ratio of the $SnO^2$ became 70 percent in weight. Then, the mixture was coated on the fourth sub-layer to a thickness of roughly 3 μm with a proper coating method such as dipping, spraying, roller coating, beam coating, or the like, to form the charge injection layer.

<Intermediary Transfer Belt>

The toner images, different in color, layered on the intermediary transfer belt 5 in the image formation stations Y, M, C, and K, one for one, are conveyed to the secondary transfer station T2 by the circular movement of the intermediary transfer belt 5. The intermediary transfer belt 5 is suspended by a tension roller 22, a driving roller 21, and a belt backing roller 23. It is circularly moved in the direction indicated by an arrow mark R2 by the clockwise rotation of the driving roller 21 at a process speed of 200 mm/sec. The driving roller 21 is such a roller that is made up of a metallic core, and an electrically conductive rubber layer which covers the peripheral surface of the metallic core. The electrical resistance of the conductive layer is $1\times10^3$~$1\times10^5$ [Ω]. The driving roller 21 is grounded.

The intermediary transfer belt 5 is made of polyimide film which is 85 μm in thickness. More specifically, the substance used as the material for the intermediary transfer belt 5 was made by dispersing carbon black in polyimide to yield a mixture which is $1\times10^{12}$ [Ω/□] in surface resistivity and $1\times10^9$ [Ω·cm] in volume resistivity.

<Secondary Transfer Station>

Figure 2:
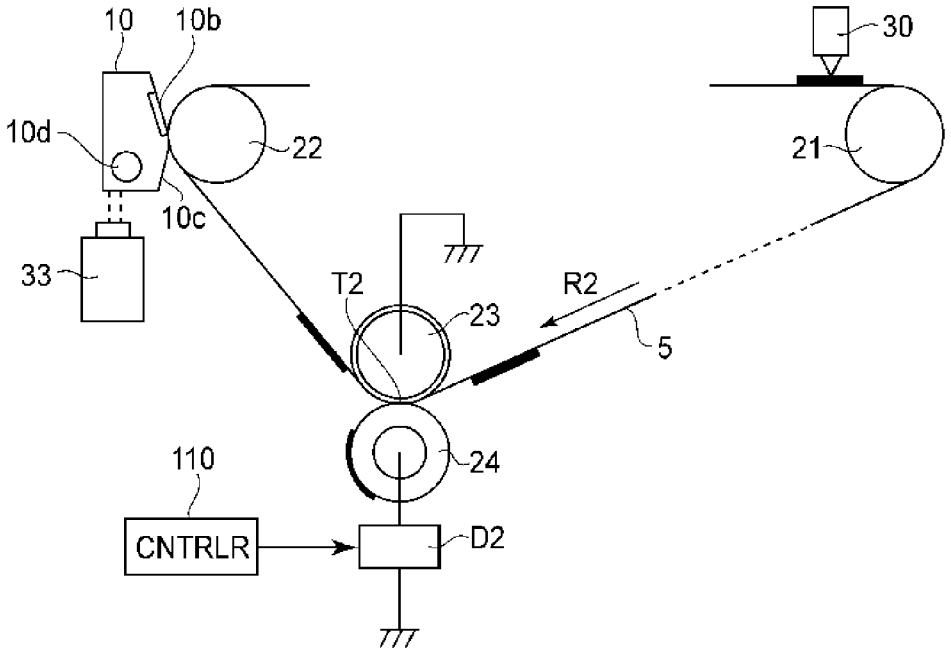
FIG. 2 is an enlarged sectional view of the secondary transfer station of the apparatus shown in FIG. 1.

FIG. 2 is an enlarged sectional view of the secondary transfer station and its adjacencies. As is evident from FIG. 2, the image forming apparatus 100 is provided with a secondary transfer roller 24, which is positioned outside the loop which the intermediary transfer belt 5 forms. Further, the secondary transfer roller 24 is positioned so that it opposes the belt backing roller 23. It forms the secondary transfer station T2 between itself and the intermediary transfer belt 5, by being pressed upon the portion of the intermediary transfer belt 5, which is supported by the belt backing roller 23 from within the belt loop. The secondary transfer station T2 is where the toner image(s) is transferred onto a sheet of recording medium.

The secondary transfer roller 24, which is an example of a toner image transferring member in the form of a roller, has an elastic layer formed of spongy rubber. It is placed in contact with the intermediary transfer belt 5, forming a transfer station in which the toner image(s) is transferred onto a sheet of recording medium. The secondary transfer roller 24 is made up of a cylindrical metallic core and an electrically conductive layer. The cylindrical metallic core is 8 mm in diameter, and is formed of electrically conductive metal. The electrically conductive layer covers the peripheral surface of the cylindrical metallic core, and is formed of an electrically conductive spongy substance. It is $5.0\times10^6$ [Ω/cm] in volume resistivity and 1.0 mm in thickness. The secondary transfer roller 24 is 300 g in weight. In order to keep the secondary transfer roller 24 in contact with the intermediary transfer belt 5, its lengthwise end portions are kept under a total pressure of 15 N generated vertically upward by an unshown mechanism made up of springs. The secondary transfer roller 24 is positioned 2.5 mm downstream in terms of the recording medium conveyance direction relative to the vertical line which coincides with the axial line of the belt backing roller 23.

<Belt Cleaning Device>

A cleaning blade 10*b* recovers the toner having adhered to the intermediary transfer belt 5. It is between the secondary transfer station T2 (example of toner image transfer station) and image formation station Y. The belt cleaning device 10 recovers the transfer residual toner, that is, the toner which failed to be transferred onto a sheet P of recording medium, in the secondary transfer station T2, and therefore, is remaining on the intermediary transfer belt 5, on the downstream side of the secondary transfer station T2. The belt cleaning device 10 scrapes away the transfer residual toner from the intermediary transfer belt 5 by placing its cleaning blade 10*b* in contact with the portion of the intermediary transfer belt 5, which is backed up by the tension roller 22. It collects the transfer residual toner as the toner is scraped away from the intermediary transfer belt 5, and falls down from the intermediary transfer belt 5. Then, it delivers the collected transfer residual toner to a screw 10*d*. The recovered transfer residual toner is stored in the waste toner container 33 which is in the front end portion of the main assembly of the image forming apparatus 100.

The cleaning blade 10*b* is kept under the pressure generated by springs, and is kept in such an attitude that the angle of contact between the cleaning blade 10*b* and intermediary transfer belt 5 is 17 degrees, and also so that its cleaning edge is on the upstream side of its base portion in terms of the moving direction of the intermediary transfer belt 5. It is formed of urethane rubber, and is 1~2 mm in thickness.

The scooping sheet 10*c* is 20~50 μm in thickness, and is made of a sheet of polyethylene terephthalate. It is for preventing the problem that as the transfer residual toner is scraped away from the intermediary transfer belt 5, it temporarily adheres to the cleaning edge of the cleaning blade 10*b*, agglomerating, and then, falls. Thus, it is placed in contact with the intermediary transfer belt 5 in such an attitude that its cleaning edge, with which it contact contacts the intermediary transfer belt 5, is on the downstream side of its base portion in terms of the moving direction of the intermediary transfer belt 5.

<Recording Medium Feeding Station>

Recording medium cassettes 16 and 12 are for storing sheets P of recording medium which are different in the size and type (ordinary paper, coated paper, transparent film, etc.). As a sheet P of recording medium is pulled out of the recording medium cassette 16, for example, a separation roller 13 separates the sheet P from the rest of the sheets P in the cassette 16, and sends the sheet P to a pair of registration rollers 15. The registration rollers 15 catch the sheet P while remaining stationary, and keep the sheet P on standby. Then, they send the sheet P to the secondary transfer station T2 with such a timing that the sheet P arrives at the secondary transfer station T2 at the same time as the toner image(s) on the intermediary transfer belt 5. That is, the sheets P of recording medium in the recording medium cassette 16 and 12 are delivered to the secondary transfer station T2 with such a timing that they arrive at the secondary transfer station T2 at the same time as the four toner images, different in color, on the intermediary transfer belt 5. Then, the four toner images are transferred onto the sheet P, in the secondary transfer station T2.

<Cleaning Mode>

Next, referring to FIG. 2, a control section 110, which is an example of controlling means, is capable of making the image forming apparatus 100 operate in the cleaning mode for electrostatically transferring the toner having adhered to the secondary transfer roller 24, onto the intermediary transfer belt 5, and recovering the transferred toner on the intermediary transfer belt 5 by the cleaning blade 10*b*. In the cleaning mode, first, electrical current is flowed between the secondary transfer roller 24 and intermediary transfer belt 5 in the same direction as the direction in which electrical current is flowed to transfer the toner images onto a sheet P of recording medium, and then, in the opposite direction from the direction in which electrical current is flowed to transfer a toner image onto a sheet P of recording medium.

During an image forming operation by the image forming apparatus 100, a patch (toner image) for controlling the image forming apparatus 100 in toner density is formed in each of the image formation stations Y, M, C, and K, and is transferred onto the intermediary transfer belt 5. Then, the toner density of each patch is detected by an optical sensor 30, which projects a beam of infrared light upon the patch on the intermediary transfer belt 5, and detects the amount of the infrared light reflected by the patch.

The control section 110 adjusts the amount by which toner is delivered from the toner supply container 8Y to the developing device 4Y, based on the output of the optical sensor 30, so that the amount of toner charge Q/M is kept stable to ensure that the image forming apparatus 100 remains stable in reproducibility in terms of image density.

In order to prevent the image forming apparatus 100 from being reduced in productivity, the aforementioned image density adjustment patch for adjusting the image forming apparatus in image density is formed during one of the image intervals (recording sheet intervals), with the secondary transfer roller 24 being kept in contact with the intermediary transfer belt 5. Further, in order to ensure that the cleaning blade 10*b* of the belt cleaning device 10 remains properly lubricated, a toner image (lubricatory toner image) shaped like a belt is formed during one of the image intervals (recording sheet intervals), with the secondary transfer belt 24 being kept in contact with the intermediary transfer belt 5.

When the image density control patch or cleaning blade lubrication toner belt is formed, no recording medium is fed, and voltage which is opposite in polarity to the voltage to be applied to the secondary transfer roller 24 during a normal secondary transfer process, is applied to the secondary transfer roller 24. Thus, the image density control patch or cleaning blade lubrication belt is simply moved through the secondary transfer station T2, and is recovered by the cleaning blade 10*b* of the belt cleaning device 10.

However, even if the voltage applied to the secondary transfer roller 24 is opposite in polarity from the voltage applied to the secondary transfer roller 24 during a normal secondary transfer process, the image density control patch and lubrication toner belt partially remain adhered to the secondary transfer roller 24, since the secondary transfer roller 24 is kept pressed upon the image density adjustment patch. Thus, as the next sheet P of recording medium is conveyed through the secondary transfer station T2, the back surface of the sheet P is soiled with the toner on the secondary transfer roller 24.

Therefore, the control section 110 operates the image forming apparatus 100 in the cleaning mode immediately after the conveyance of the image density adjustment patch or lubricatory toner belt through the secondary transfer station T2, in order to remove the toner on the secondary transfer roller 24. In the cleaning mode, the positively charged toner, and negatively charged toner, on the secondary transfer roller 24 are transferred onto the intermediary transfer belt 5 by alternately applying voltage which is the same in polarity as the voltage to be applied to the secondary transfer roller 24 during a normal image formation process, and voltage which is opposite in polarity from the voltage to be applied to the secondary transfer roller 24 during a normal image formation process, to the secondary transfer roller 24 for a length of time which is equivalent to no less than two full rotations of the secondary transfer roller 24. The reason for alternately applying the voltages which are opposite in polarity is to prevent the toner on the secondary transfer roller 24 from remaining adhered to the back surface of a sheet P of recording medium.

The process of operating an image forming apparatus in the cleaning mode in which the normal and reverse voltages are alternately applied to the secondary transfer roller 24 in order to prevent a sheet P of recording medium from being soiled by the toner on the secondary transfer roller 24, by causing the toner embedded in the spongy layer of the secondary transfer roller 24 to transfer onto the intermediary transfer belt 5, has long been practiced.

However, it has not been known that as the voltage opposite in polarity from the voltage applied to the secondary transfer roller 24 during a normal image formation process is applied to the secondary transfer roller 24 in the cleaning mode, a substantial amount of paper dust having accumulated on the secondary transfer roller 24 during the preceding continuous conveyance of a substantial number of sheets of recording medium through the secondary transfer station T2, transfers onto the intermediary transfer belt 5. That is, it has not been known that as the above described voltages are applied to the secondary transfer roller 24 in the cleaning mode, the paper dust having accumulated on the secondary transfer roller 24 because of the conveyance of a substantial number of sheets of recording medium is transferred, in addition to the toner on the secondary transfer roller 24, onto the intermediary transfer belt 5, and is conveyed to the belt cleaning device 10.

Neither has it been known that as the paper dust is transferred onto the intermediary transfer belt 5, it affects the life (replacement interval) of the cleaning blade 10*b* of the belt cleaning device 10 which is on the downstream side of the secondary transfer station T2 in terms of the recording medium conveyance direction. It has been thought that even if the amount of the paper dust transferred onto the intermediary transfer belt 5 is substantial, the paper dust and toner become mixed and are stirred by the cleaning edge of the cleaning blade 10*b*, and therefore, can be effectively scrapped away by the cleaning blade 10*b*, and recovered, as long as the cleaning edge 10*b* is in the normal condition.

However, it has been discovered that in a case where a substantial number of images which are low in image ratio are continuously outputted, and therefore, the cleaning blade 10*b* is not supplied with a proper amount of transfer residual toner, the cleaning edge portion of the cleaning blade 10*b* is deformed, being therefore likely to be affected by the paper dust; as the reverse bias current is flowed the paper dust particles stick to the cleaning edge of the cleaning blade 10*b* and/or get stuck between the intermediary transfer belt 5 and the cleaning edge of the cleaning blade 10*b*.

The paper dust mostly consists of minutes pieces of cellulose of which recording paper is made. The minute pieces of cellulose are roughly 20~50 μm in thickness and 200~800 μm in length. The size of these minute pieces of cellulose is very large compared to that of the toner particles which are 5~7 μm in average diameter. Therefore, as the paper dust gets stuck between the cleaning edge portion of the cleaning blade 10*b* and the intermediary transfer belt 5, gaps are created between the cleaning edge of the cleaning blade 10*b* and intermediary transfer belt 5, allowing thereby some toner particles to slip by the cleaning edge.

In the following embodiments of the present invention, the voltage, which is opposite in polarity from the voltage to be applied to the secondary transfer roller 24 during a normal image formation process, and is applied to the secondary transfer roller 24 in the cleaning mode, is adjusted to prevent the problem that some transfer residual toner slips by the cleaning blade and soils the secondary transfer roller 24, which results in the soiling of the back surface of a sheet of recording medium.

Embodiment 1

Figure 3:
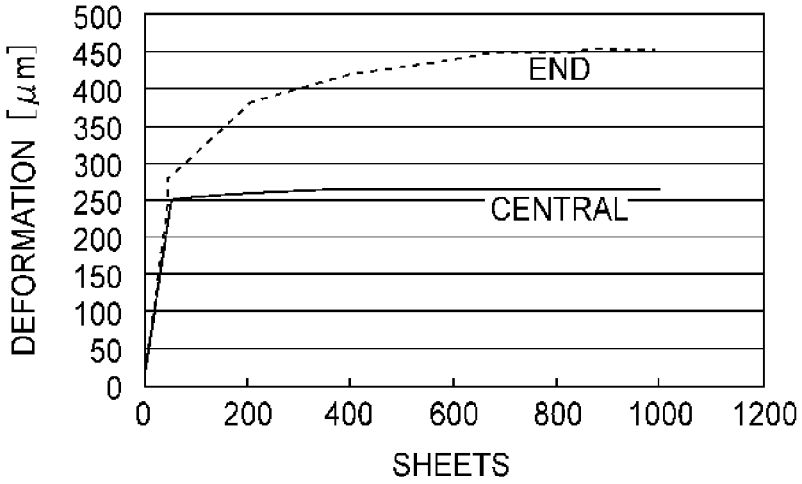
FIG. 3 is a graph showing the difference, in terms of the amount of deformation, between the lengthwise center portion and one of lengthwise end portions of the cleaning blade, changes in the relationship, and also, the relationship between the amount of deformation of the cleaning blade, and the cumulative number of sheets of recording medium conveyed through the apparatus.
Figure 4:
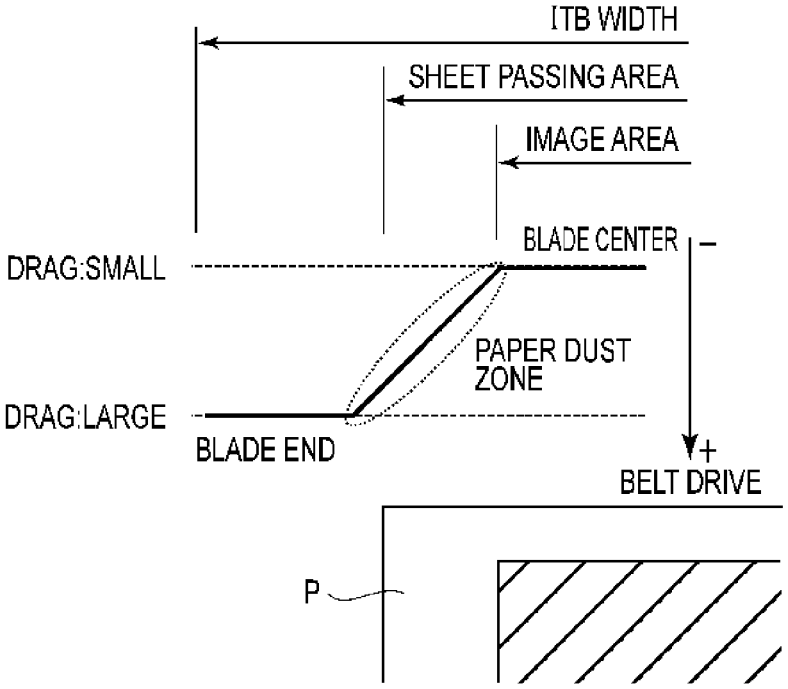
FIG. 4 is a drawing for describing the deformation of the specific portions of the cleaning edge portion of the cleaning blade.
Figure 5:
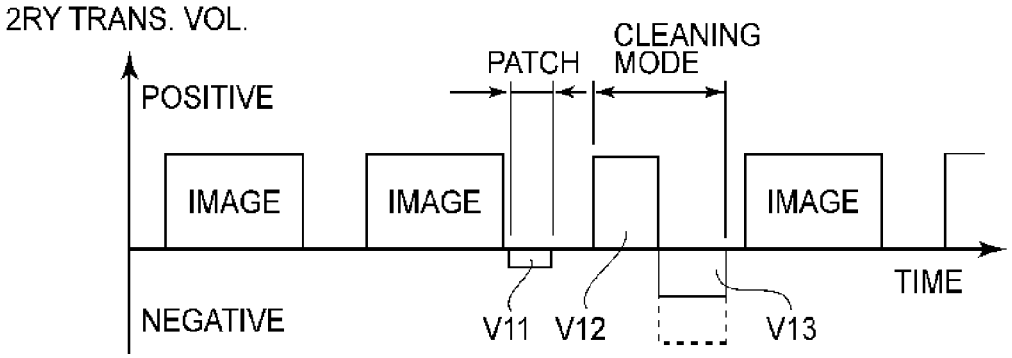
FIG. 5 is timing diagram for the cleaning mode in the first embodiment.
Figure 6:
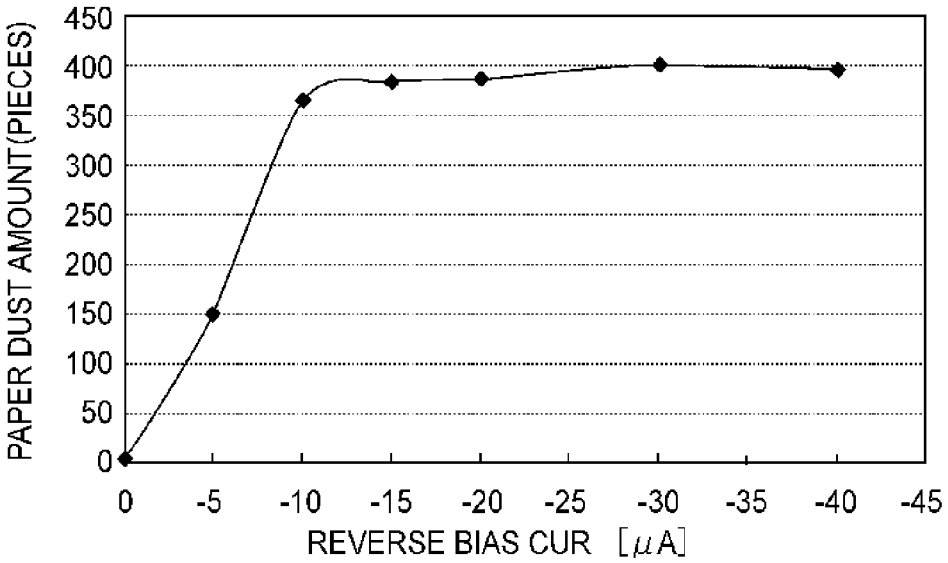
FIG. 6 is a graph showing the relationship between the amount of the reverse bias current and the amount by which paper dust was transferred.
Figure 7:
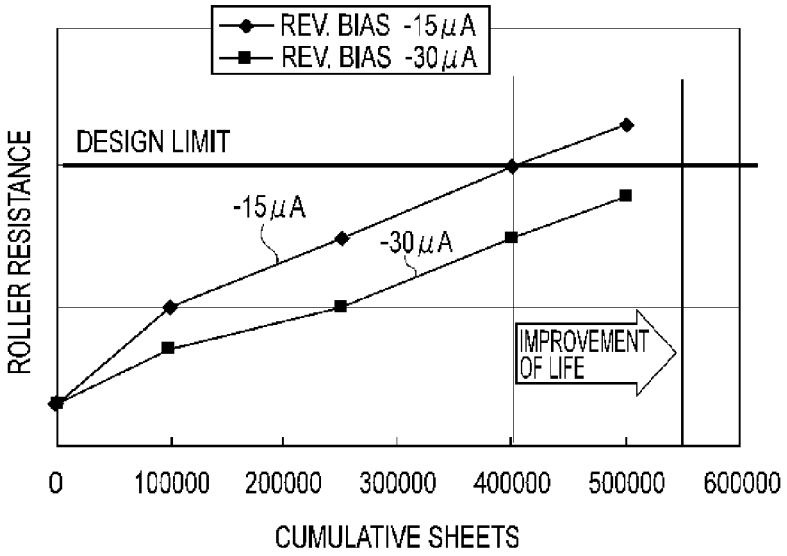
FIG. 7 is a graph showing the relationship between the changes in the electrical resistance of the secondary transfer roller, and the cumulative number of sheets of recording medium conveyed through the image forming apparatus.

FIG. 3 is a drawing for describing the relationship between the cumulative number of sheets of recording medium conveyed between the cleaning blade 10*b* and intermediary transfer belt 5, and the difference in the amount of deformation between the lengthwise center and the lengthwise end portions of the cleaning blade. FIG. 4 is a drawing for describing the deformation of the specific portion of one of the lengthwise end portions of the cleaning blade. FIG. 5 is a timing diagram for the cleaning mode in the first embodiment. FIG. 6 is a drawing for describing the relationship between the amount of the reverse bias current and the amount by which paper dust is moved onto the intermediary transfer belt 5 by the reverse bias current. FIG. 7 is a drawing for describing the relationship between the cumulative number of the sheets of recording medium conveyed between the cleaning blade and intermediary transfer belt 5, and the change in the electrical resistance of the secondary transfer roller 24.

Referring to FIG. 2, in the cleaning mode, the larger the amount by which paper dust is adhered to the secondary transfer roller 24, the smaller the control section 110 makes the amount by which electrical current is to be flowed through the secondary transfer station T2 in the opposite direction from the direction in which electric current is to be flowed through the secondary transfer station T2 during a normal toner image transfer process. Further, the larger the cumulative number by which sheets of recording medium were conveyed since the image forming apparatus 100 is operated last time in the cleaning mode, the smaller the control section 110 makes the amount by which electric current is to be flowed through the secondary transfer station T2 in the opposite direction from the direction in which electric current is flowed through the secondary transfer station T2 during a normal secondary transfer process. Further, when the paper used as recording medium is such paper that produces a large amount of paper dust, the control section 110 makes smaller the amount by which electric current is to be flowed through the secondary transfer station T2 in the opposite direction from the direction in which electric current is flowed through the secondary transfer station T2 a normal secondary transfer process.

First, a preliminary test is carried in which the behavior of the cleaning edge portion of the cleaning blade 10*b*, which occurs when a substantial number of images are continuously formed, is measured with the use of a gauge for measuring deformation.

Referring to FIG. 2, three deformation gauges 32 which are for measuring the amount of deformation of a stationary object are attached to the belt contacting surface of the cleaning blade 10*b*. In terms of the direction perpendicular of the lengthwise direction of the cleaning edge of the cleaning blade 10*b*, they were positioned roughly 1.5 mm from the cleaning edge of the cleaning blade 10*b*. In terms of the lengthwise direction of the cleaning blade 10*b*, they were positioned at the center portion and end portions, one for one, of the cleaning blade 10*b*. The output of the deformation gauge 32, which indicates the electrical resistance of the portion of the cleaning blade 10*b* to which the gauge 32 is attached, is converted into voltage, and is inputted into a personal computer, obtaining thereby the amount of deformation of the portion of the cleaning blade 10*b*, with which the gauge 32 is in contact.

Next, referring to FIG. 3, as the cumulative image formation count increases, the amount of deformation of the cleaning blade 10*b* increases. The amount of deformation of the lengthwise center portion of the cleaning blade 10*b* converges to a certain value early on. However, the lengthwise end portions of the cleaning blade keeps on increasing in the amount of deformation. The amounts of deformation shown in FIG. 3 are the values obtained by measuring the electrical signals which were outputted by the deformation gauge 32. They are proportional in magnitude to the amount of deformation of the cleaning blade 10*b*. "0" stands for the amount of deformation when the intermediary transfer belt 5 is stationary. The axis of ordinate stands for the amount of the downstream deformation in terms of the moving direction of the intermediary transfer belt 5.

The amount by which the lengthwise end portions of the cleaning blade 10*b* are deformed by being dragged by the intermediary transfer belt 5 is greater than the amount by which the lengthwise center portion of the cleaning blade 10 is deformed by being dragged by the intermediary transfer belt 5. Therefore, as the cumulative number of sheets of recording medium which were conveyed for continuous formation of images increase, the difference in the amount of deformation between the lengthwise end portions of the cleaning blade 10*b* and the lengthwise center portion of the cleaning blade 10*b* increases. That is, the lengthwise end portions of the cleaning blade 10*b* become larger than the lengthwise center portion of the cleaning blade 10*b* in terms of the distance by which they are moved downstream from the position "0" by being dragged by the intermediary transfer belt 5.

Next, the two deformation gauges 32 attached to lengthwise end portions of the cleaning blade 10*b* are changed several times in position toward the center of the blade 10*b* in terms of the lengthwise direction of the blade 10*b* by being repasted, and the amount of deformation of the portions of the cleaning blade 10*b*, to which the deformation gauge 32 were moved, is obtained using the same method, so that the distribution of the amount of deformation of the cleaning blade 10*b* in terms of the lengthwise direction of the cleaning blade 10*b* is obtained. The thus obtained distribution of the amount of deformation of the cleaning blade 10*b* reveals that in the specific portions of the cleaning blade 10*b* in terms of the lengthwise direction of the blade 10*b* are stretched, and become afloat from the surface of the intermediary transfer belt 5.

Next, referring to FIG. 4, there is a distinctive difference in the amount of deformation between the portion of the cleaning blade 10*b*, which corresponds in position to the image formation area of a sheet of recording medium, and the portion of the cleaning blade 10*b*, which corresponded in position to the out-of-image-formation-area of the sheet of recording medium. The axis of abscissa of FIG. 4 stands for the point of the cleaning blade 10*b* in terms of its lengthwise direction, and the axis of ordinate of FIG. 4 stands for the amount of deformation of the cleaning blade 10*b*. If a value which shows the amount of deformation of the cleaning blade 10*b* has a positive sign, it means that the cleaning blade 10*b* was dragged in the direction parallel to the moving direction of the intermediary transfer belt 5, and were remaining in the position to which they were dragged by the intermediary transfer belt 5.

The amount by which lubricant, such as toner, is supplied, by way of the intermediary transfer belt 5, to the outward portion of the border (buckled portion) between the lengthwise center portion of the cleaning blade 10*b* and the lengthwise end portions of the cleaning blade 10 is substantially smaller than that to the lengthwise end portions. In other words, the portions of the cleaning blade 10*b* which is on the outward side of the image formation area, is hardly supplied with toner or the like as lubricant. Therefore, once they are dragged by the intermediary transfer belt 5 in the moving direction of the intermediary transfer belt 5, they tend to remain in the positions to which they are dragged.

In comparison, the portion of the cleaning blade 10*b*, which corresponds in position to the image formation area of a sheet of recording medium, is supplied with toner or the like as lubricant. Therefore, they are not dragged by the intermediary transfer belt 5 in the moving direction of the intermediary transfer belt 5 as much as the amount by which the portions of the cleaning blade 10*b*, which are outside the image formation area of the sheet of recording medium are dragged downstream. It was across the portions of the cleaning blade 10*b*, which are between the portion of the cleaning blade 10*b*, which were dragged downstream by a substantial distance by the intermediary transfer belt 5, and the lengthwise center portion of the intermediary transfer belt 10*b*, that the paper dust tended to collect. At the end of the continuous formation of a substantial number of images, the cleaning blade 10*b* was removed from the belt cleaning device 10, and the cleaning edge of the cleaning blade 10*b* was examined with the use of a microscope. The examination confirmed that a large number of tiny pieces of paper dust became embedded in the portion of the cleaning edge of the cleaning blade 10*b*, which is surrounded by a broken line in FIG. 4.

Next, referring to FIG. 5, as a patch for controlling the image forming apparatus 100 in image density is transferred onto the intermediary transfer belt 5, it is simply moved through the secondary transfer station T2 by the application of a voltage V11, which is opposite in polarity from the voltage to be applied to the secondary transfer roller 24 during a normal secondary transfer process, to the secondary transfer roller 24. During this operation, some toner particles of the patch adhere to the secondary transfer roller 24. Thus, the control section 110 operates the image forming apparatus 100 in the cleaning mode to remove the toner particles on the secondary transfer roller 24.

In the cleaning mode in the first embodiment, first, a transfer voltage V12 which is the same in polarity as the voltage to be applied to the secondary transfer roller 24 during the normal secondary transfer process is applied to the secondary transfer roller 24 for a length of time equivalent to one full rotation of the secondary transfer roller 24, and then, a transfer voltage V13 which is opposite in polarity from the voltage to be applied to the secondary transfer roller 24 during the normal secondary transfer process, is applied to the secondary transfer roller 24 for a length of time equivalent to one a full rotation of the secondary transfer roller 24, in order to transfer the toner on the secondary transfer roller 24 back onto the intermediary transfer belt 5. As the toner on the secondary transfer roller 24 is transferred back onto the intermediary transfer belt 5, it is conveyed by the intermediary transfer belt 5 to the belt cleaning device 10, in which it is recovered by the cleaning blade 10*b*.

However, as the voltage V13, which is opposite in polarity from the voltage to be applied to the secondary transfer roller 24 during the normal secondary transfer process, is applied to the secondary transfer roller 24, the paper dust, which was generated from sheets of recording medium while a substantial number of images were continuously formed, and accumulated on the surface of the secondary transfer roller 24, is expelled, along with the toner on the secondary transfer roller 24, onto the intermediary transfer belt 5. The portion of the paper dust which reached the lengthwise center portion of the cleaning blade 10*b* is normally scraped away from the intermediary transfer belt 5 by the cleaning edge of the cleaning blade 10*b*. However, the portion of the paper dust which reached the portion of the cleaning blade 10*b*, which is surrounded by the broken line in FIG. 4, that is, the portion which was stretched and separated from the intermediary transfer belt 5, gets stuck (collects) between the portion of the cleaning blade 10*b* surrounded by the broken line in FIG. 4, and the intermediary transfer belt 5, increasing thereby the gap between the cleaning blade 10*b* and intermediary transfer belt 5. As the paper dust collects between the cleaning edge of the cleaning blade 10*b* and intermediary transfer belt 5, the portions of the cleaning edge, which are adjacent to the stuck paper dust, fail to scrape away the toner on the surface of the intermediary transfer belt 5. Consequently, the toner slips by the cleaning blade 10*b*.

Thus, an experiment was carried out in which in the cleaning mode, the voltage V13 which is to be applied to the secondary transfer roller 24 and is opposite in polarity from the voltage to be applied to the secondary transfer roller 24 during the normal secondary transfer process, was varied in magnitude, in order to compare the amounts by which the paper dust transferred from the secondary transfer roller 24 onto the intermediary transfer belt 5. The experiment revealed that the amount by which the paper dust transfers from the secondary transfer roller 24 onto the intermediary transfer belt 5 can be reduced by reducing in magnitude the reverse polarity voltage V13.

The details of the experiment are as follows: the toner and paper dust on the intermediary transfer belt 5 was collected by pasting a piece of transparent adhesive tape on the portion of the intermediary transfer belt 5, which was cleaned by the cleaning blade 10*b* in the cleaning mode. Then, the tape was peeled from the intermediary transfer belt 5, and pasted to the sheet of black paper. Then, the tape was read by a flat bed scanner, and the obtained image of the tape was processed to count the number of pieces of paper dust attached to the tape.

The results of the experiment are shown in FIG. 6. The amount of paper dust, which the axis of ordinate of FIG. 6 represents, is the number of the paper dust particles obtained by converting the measured density of the paper particles on the tape, into a value in which the paper dust particles count will be if the tape were as large as a sheet of paper of A4 size. The reverse bias current [μA] which is represented by the axis of abscissa is the value of the electric current which flowed through the secondary transfer station T2 as the reverse polarity voltage V13 was flowed through the secondary transfer roller 24. The reason why the value of the electric current is used instead of the value of the voltage V13 is that the value of the voltage V13 is substantially affected by the changes in the amount of the electrical resistance of the secondary transfer roller 24.

Referring to FIG. 6, of the voltages V12 and V13, which are normal and reverse in direction, respectively, shown in FIG. 5, it is the voltage V13, that is, the reverse polarity voltage, that causes the paper dust to transfer from the secondary transfer roller 24 onto the intermediary transfer belt 5. In the case of the image forming apparatus 100 in this embodiment structured as described above, the amount by which the paper dust transfers from the secondary transfer roller 24 onto the intermediary transfer belt 5 can be reduced by reducing the amount of the reverse polarity bias current to no more than 20 μm rather than keeping it no less than 30 μm as it was in the case of the conventional image forming apparatus.

Then, the reverse bias current is changed in value, and the number of paper dust particles embedded in the cleaning blade 10*b*, and the state of soiling of a print attributable to the toner particles which slipped by the cleaning blade 10*b*, were studied. Further, the state of the paper dust stuck between the cleaning blade 10*b* and intermediary transfer belt 5, and how easily toner particles slipped by the cleaning blade 10*b*, were studied after 100, 200, 500, 1,000, and 10,000 sheets of recording medium were continuously conveyed. The results of the studies confirmed that as the reverse bias current was increased in steps from 10 μA to 30 μA, toner particles began to be allowed to slip by the cleaning blade 10*b*, by the paper dust stuck between the cleaning edge of the cleaning blade 10*b* and intermediary transfer belt 5.

TABLE 1

| | | | Cumulative number of continuous sheets | | | |
|---|---|---|---|---|---|---|
| | | | 200 | 500 | 1000 | 10000 |
| Reverse bias (μA) | −10 | Paper Dust (pieces) | 0 | 0 | 0 | 0 |
| | | Slip | No | No | No | No |
| | −15 | Paper Dust (pieces) | 0 | 0 | 0 | 0 |
| | | Slip | No | No | No | No |
| | −20 | Paper Dust (pieces) | 0 | 0 | 0 | 0 |
| | | Slip | No | No | No | No |
| | −30 | Paper Dust (pieces) | 0 | 0 | 10 | ≥100 |
| | | Slip | No | No | No | Yes |
| | −50 | Paper Dust (pieces) | 0 | 0 | 35 | ≥100 |
| | | Slip | No | No | Yes | Yes |

Referring to Table 1, as the cumulative number of continuously conveyed sheets of paper increases, the number by which the paper dust particles become embedded in the cleaning edge portion of the cleaning blade 10*b* increased, and therefore, the number by which toner particles slip by the cleaning blade 10*b* increased, for the following reason. That is, as the cumulative number of continuously conveyed sheets of paper increased, not only was the cleaning blade 10*b* changed in attitude into such an attitude that makes it easier for the paper dust to get stuck between the cleaning edge of the cleaning blade 10*b* and intermediary transfer belt 5, but also, the cleaning blade 10*b* was changed in shape into such a shape that made it easier for the paper duct to collect between the cleaning edge of the cleaning blade 10*b* and intermediary transfer belt 5. Further, it is reasonable to think that the amount in which the paper dust accumulates on the secondary transfer roller 24 is proportional to the length of time the secondary transfer roller 24 contacts a sheet of recording medium. As the paper dust accumulates by the amount large enough to allow toner particles to slip by the cleaning blade 10*b*, the cleaning blade 10*b* is thought to have reached its end of life.

In a case where the cumulative count of the continuously conveyed sheets of paper was no more than 500, flowing 10~50 μA of reverse polarity bias current through the secondary transfer station T2 prevented the accumulation of paper dust between the cleaning edge of the cleaning blade 10*b* and intermediary transfer belt 5, and also, the problem that toner slips by the cleaning blade 10*b*. However, in a case where the cumulative count of the continuously conveyed sheets of paper was no less than 1,000, flowing no less than 30 μA of reverse polarity bias current caused the paper dust to collect between the cleaning edge of the cleaning blade 10*b* and the intermediary transfer belt 5, and toner slipped by the cleaning blade 10*b*.

It is thought that in the case where no less than 1,000 sheets of paper were continuously conveyed through the secondary transfer station T2, the above described problems occurred because excessively charged paper dust particles were transferred back onto the border portion of the cleaning blade 10*b*, which is between the lengthwise center portion of the cleaning blade 10*b* and the lengthwise end portions of the cleaning blade 10*b*, and across which the difference in the amount of deformation drastically changes. It is thought as follows: Excessively increasing the amount of the reverse bias current excessively increases the amount by which paper dust is charged, by the excessive amount of supply of electric current. Therefore, the electrostatic force by which the paper dust is adhered to the intermediary transfer belt 5 is increased, making it difficult for the paper dust on the intermediary transfer belt 5 to be scraped away by the cleaning blade 10*b*, making it easier for the paper dust to collect between the cleaning edge of the cleaning blade 10*b* and intermediary transfer belt 5.

The paper dust transfer from the secondary transfer roller 24 onto the intermediary transfer belt 5 occurs mostly during the application of the reverse bias. If the reverse bias current is excessive, it supplies the paper dust with an excessive amount of electric charge, making the paper dust more adhesive to the intermediary transfer belt 5. Therefore, it becomes more difficult for the cleaning edge of the cleaning blade 10*b* to clean the intermediary transfer belt 5.

Thus, in the cleaning mode in the first embodiment, the reverse polarity voltage V13 was set so that the reverse bias current becomes no more than 20 μA. Therefore, it was possible to continuously form 10,000 images of good quality. Further, the reverse bias current was made changeable in amount according to the cumulative number of sheets of recording medium which were continuously conveyed through the secondary transfer station T2, and as the cumulative count of the sheets of recording medium which were continuously conveyed through the secondary transfer station T2 exceeded a preset value, the reverse bias current was reduced to prevent the paper dust from becoming stuck between the cleaning edge of the cleaning blade 10*b* and the intermediary transfer belt 5, even if the difference between the lengthwise end portions and center portion of the cleaning blade 10*b* in terms of the distance by which they are dragged downstream by the intermediary transfer belt 5 became substantial.

Further, the reverse bias current which was flowed in the cleaning mode was adjusted in amount according the cumulative count of the sheets of recording medium which were continuously conveyed through the secondary transfer station T2 after the image forming apparatus 100 was previously operated in the cleaning mode, that is, according to the amount of paper dust on the secondary transfer roller 24. Therefore, cleaning blade 10*b* was further extended in service life.

In the first embodiment, the reverse bias current, which was flowed in the cleaning mode, was adjusted in amount within a range of 10 μA~20 μA. Therefore, even when no less than 1,000 sheets of recording medium were continuously conveyed through the secondary transfer station T2, paper dust hardly stuck between the cleaning edge the cleaning blade 10*b* and the intermediary transfer belt 5, and therefore, the cleaning blade 10*b* hardly lost its ability to clean the intermediary transfer belt 5, allowing therefore hardly any toner particle to slip by the cleaning blade 10*b*. Thus, the secondary transfer roller 24 remained clean.

As long as the amount of reverse bias current is kept within the range of 10 μA~20 μA, it is large enough to remove the toner on the secondary transfer roller 24, even if the difference in the amount of deformation between the portions of the cleaning blade 10*b*, which are within the path of the image formation area of a sheet of recording medium, and the portion of the cleaning blade 10*b*, which is outside the path of the image formation area of a sheet of recording medium, becomes substantial. Therefore, the first embodiment of the present invention can prevent paper dust from collecting on the cleaning edge of the cleaning blade 10*b*, and therefore, can keep the cleaning blade 10*b* at the highest level in terms of cleaning performance.

Incidentally, the reason why the amount of the reverse bias current is not fixed to 10 μA, which minimizes the amount by which paper dust transfers onto the intermediary transfer belt 5, is as follows. In the first embodiment, the reverse bias current which is flowed in the cleaning mode is utilized to extend the secondary transfer roller 24 in life, as disclosed in the second patent document. It is not always true that the reverse bias current which is to be flowed in the cleaning mode to avoid the cleaning failure attributable to the sticking of paper dust to the cleaning edge of the cleaning blade 10*b* has only to be always set to a low value in any situation.

Referring to FIG. 7, in the cleaning mode, the reverse bias current was set to 15 μA and 30 μA, and the changes which occurred to the amount of electrical resistance of the secondary transfer roller 24 were studied. In the case where the reverse bias current flowed in the cleaning mode was smaller, the rate with which the electrical resistance of the secondary transfer roller 24 increased was higher than in the case where the reverse bias current was larger, and therefore, the voltage to be applied to flow a preset amount of the normal bias current becomes higher. In order to increase the normal voltage for flowing the normal bias current, not only does the power source increase in cost, but also, in power consumption. Further, the deterioration of the secondary transfer roller 24 attributable to electrical discharge is accelerated, reducing in life the secondary transfer roller 24.

Thus, in a case where the cumulative count of the sheets of recording medium which were continuously conveyed through the secondary transfer station T2 after the image forming apparatus 100 was operated last time in the cleaning mode was small, and therefore, the difference in the amount of deformation between the lengthwise center portion of the cleaning blade 10*b* and the lengthwise end portions did not become substantial, the reverse bias current is set to 20 μA. In comparison, in a case where the cumulative count of the sheets of recording medium which were continuously conveyed through the secondary transfer sation T2 after the image forming apparatus 100 was operated last time in the cleaning mode is substantial, and therefore, the difference in the amount of deformation between the lengthwise center portion of the cleaning blade 10*b* and the lengthwise end portions become substantial, the reverse bias current is reduced to 10 μA, which is the minimum amount necessary to satisfactorily remove the toner on the secondary transfer roller 24. Thus, the back surface of a sheet of recording medium is not soiled by the toner even though the secondary transfer roller 24 is going to be reduced in life.

In a case where the number of sheets of recording medium which are to be continuously conveyed through the secondary transfer station T2 is no more than 100, the reverse bias current is increased to 30 μA to prevent the secondary transfer roller 24 from increasing in electrical resistance.

Embodiment 2

Figure 8:
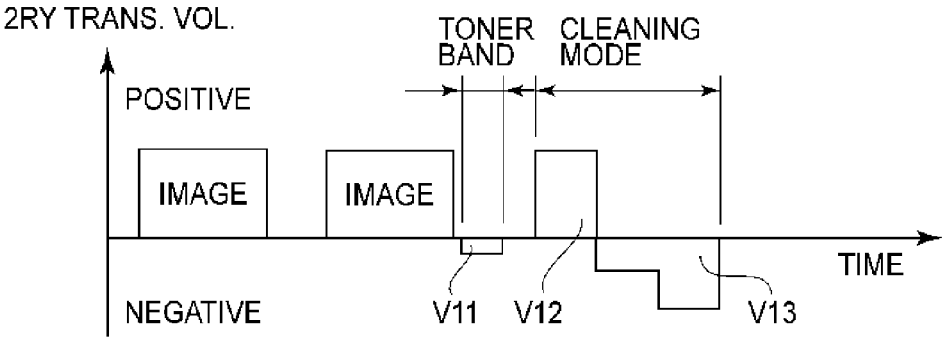
FIG. 8 is timing diagram for the cleaning mode in the second embodiment.

FIG. 8 is a timing diagram for the cleaning mode in the second embodiment of the present invention. Referring to FIG. 8, in the second embodiment, each time 500 images are finished, a toner belt which is as long as the length of the development roller is formed in one of the image formation stations (Y, M, C, and K), which is smallest in the amount of toner consumption. Then, the toner belt is transferred onto the intermediary transfer belt 5 to provide the entirety of the cleaning edge of the cleaning blade 10*b* of the belt cleaning device 10 with lubricatory toner.

Also referring to FIG. 8, while the toner belt moves through the secondary transfer station T2, the voltage V11, which is opposite in polarity from the voltage to be applied during a normal image formation process, is applied to the secondary transfer roller 24 as it was in the case of the image density control patch in the first embodiment. Then, immediately after the passage of the toner belt through the secondary transfer station T2, the normal transfer voltage V12 and reverse transfer voltage V13 are applied to the secondary transfer roller 24 to remove the toner on the secondary transfer roller 24.

In the second embodiment, however, a transfer voltage V12, which is the same in polarity as the voltage to be applied during a normal image formation process, is applied to the secondary transfer roller 24 for a length of time equivalent to one full rotation of the secondary transfer roller 24, and then, the transfer voltage V13, which is opposite in polarity from the voltage to be applied to the secondary transfer roller 24 during a normal image formation process and is capable of flowing 10 μA of reverse bias current, is applied to the secondary transfer roller 24 for a length of time equivalent to three full rotations of the secondary transfer roller 24. This practice has such an effect that is similar, in terms of extending the secondary transfer roller 24 in life, to the practice of flowing 30 μA of the reverse bias current for a length of time equivalent to one full rotation of the secondary transfer roller 24 as in the first embodiment.

Because the transfer voltage V13 which is equivalent to 10 μA of reverse bias current is used, the amount by which the paper dust which is generated from the sheets of recording medium during the continuous formation of a substantial number of images, and accumulates on the peripheral surface of the secondary transfer roller 24, is expelled onto the intermediary transfer belt 5, is controlled, and therefore, it is unlikely for a large amount of paper dust to get stuck between the cleaning edge of the cleaning blade 10*b* and the intermediary transfer belt 5.

In recent years, recording media have increased in size (width as well as length) and type. Thus, the number of image forming apparatuses capable of dealing with a recording sheet of a large size, for example, 11 inch×13 inch, has increased. In order for an image forming apparatus to be able to handle a large sheet of recording medium, the photosensitive drum, intermediary transfer belt, transferring member, cleaning blade, etc., of the image forming apparatus also have to be increased in size (length). Lengthening a cleaning blade makes the lengthwise end portions of the cleaning blade even lager in the amount of deformation than the lengthwise center portion of the cleaning blade. Thus, not only does it make it more difficult to maintain the cleaning edge of the cleaning blade in attitude, but also, it makes easier for the cleaning edge portion of the cleaning blade to deform. Therefore, in the second embodiment, the lubricatory toner belt is used to supply the entirety of the cleaning edge of the cleaning blade with the lubricatory toner, in order to make it difficult for the paper dust to get stuck between the cleaning edge of the cleaning blade and the intermediary transfer belt.

Embodiment 3

Image ratio" of an image means the ratio of the total portions of the image formation area of a sheet of recording medium to which toner is adhered, relative to the total image formation area of the sheet P of recording medium, with the density of the image converted to the highest level. An image which is low in image ratio is such an image that is high in the ratio of its white (blank) area, and therefore, is small in the amount of toner consumption per sheet of recording medium. Thus, in a case where a substantial number of sheets of recording medium are continuously conveyed to form images which are low in image ratio, the amount by which the transfer residual toner is generated in secondary transfer station T2 is small, and therefore, it becomes likely for the cleaning blade 10*b* of the belt cleaning device 10 to be insufficiently provided with the lubricatory toner.

Referring to FIG. 2, in a case where the image forming apparatus 100 is made to continuously output a substantial number of images which are low in image ratio, the lengthwise end portions of the cleaning blade 10*b* is insufficiently supplied with lubricatory toner. Thus, there occurs a substantial amount of difference between the lengthwise center portion of the cleaning blade 10*b* and the lengthwise end portions of the cleaning blade 10*b*, in terms of the distance by which they are dragged downstream by the intermediary transfer belt 5. In other words, because the lengthwise end portions of the cleaning blade 10*b*, which is difficult for the lubricatory toner to reach, and the lengthwise center portion of the cleaning blade 10*b*, which is easily supplied with the lubricatory toner, become different from each other in the terms of the distance by which they are dragged downstream by the intermediary transfer belt 5. Therefore, the cleaning edge of the cleaning blade 10*b* buckles between its lengthwise end portions and lengthwise center portion.

Next, referring to FIG. 4, if the image forming apparatus 100 is operated in the cleaning mode after the difference between the lengthwise center portions of the cleaning blade 10*b* and the lengthwise center portion of the cleaning blade 10*b* in terms of the distance by which they were displaced downstream by being dragged by the intermediary transfer belt 5 become substantial, the paper dust is likely to collect between the portion of the cleaning edge of the cleaning blade 10*b*, which is surrounded by the broken line in FIG. 4, and the intermediary transfer belt 5. More concretely, as the reverse bias current is flowed between the secondary transfer roller 24 and intermediary transfer belt 5, the paper dust is transferred onto the intermediary transfer belt 5 across the entirety of the belt 5 in terms of the widthwise direction of the belt 5. However, it is only between the portion of the cleaning edge of the cleaning blade 10, which is surrounded by the broken line in FIG. 4, and the intermediary transfer belt 5, where the paper dust collects.

In the cleaning mode, the secondary transfer roller 24 is cleaned by the application of both the bias which is the same in polarity as the normal bias applied to the secondary transfer roller 24 during a normal image formation process, and the bias which is opposite in polarity from the normal bias applied to the secondary transfer roller 24 during a normal image formation process, to the secondary transfer roller 24. However, as the reverse bias is applied, the paper dust having accumulated on the secondary transfer roller 24 transfers onto the intermediary transfer belt 5, along with the toner on the secondary transfer roller 24. Then, the paper dust and toner on the intermediary transfer belt 5 are conveyed to the belt cleaning device 10 by the intermediary transfer belt 5, and recovered by the cleaning blade 10*b*. However, the buckled portions of the cleaning edge of the cleaning blade 10*b* fail to recover the paper dust on the intermediary transfer belt 5. Thus, the paper dust particles on the portions of the intermediary transfer belt 5, which corresponds in position to the buckled portions of the cleaning edge of the cleaning blade 10*b*, end up collecting between the cleaning edge and intermediary transfer belt 5.

As the paper dust collects on the cleaning edge of the cleaning blade 10*b*, it lifts the cleaning edge, making it easier for the paper dust to collect between the cleaning edge and intermediary transfer belt 5. As the paper dust collects between the cleaning edge and intermediary transfer belt 5, the cleaning blade 10*b* loses its ability to clean the intermediary transfer belt 5. That is, it allows the toner on the intermediary transfer belt 5 to slip by the cleaning blade 10*b*.

In the third embodiment, therefore, at the end of each image formation job, the image forming apparatus 100 is operated in the cleaning mode in which the amount of the reverse bias current is set according to the average image ratio of the completed image formation job.

TABLE 2

| | Image ratio (%) | | |
|---|---|---|---|
| No. of sheets in job | <5% | 5-20% | ≥20% |
| <1000 | 10 μA | 15 μA | 20 μA |
| ≥1000 | 10 μA | 10 μA | 20 μA |

Referring to Table 2, in an image forming operation in which a substantial number of images which are no more than 5% in image ratio are continuously formed, the amount of reverse bias current is set to 10 μA. In comparison, in an image forming operation in which a substantial number of images which are no less than 20% in image ratio are continuously formed, the amount of reverse bias current is set to 20 μA. Further, in an image forming operation in which a substantial number of images are formed, the image ratio of which is in a range of 5%~20%, the amount of reverse bias current is set to 15 μA.

The difference between the lengthwise center portion of the cleaning blade 10*b* and the lengthwise end portions of the cleaning blade 10*b* in terms of the distance by which they are dragged downstream by the intermediary transfer belt 5 is roughly proportional to the number of sheets of recording medium which are continuously conveyed through the secondary transfer station T2 during each printing job. Thus, in an image forming operation in which the cumulative number of the sheets of recording medium which are continuously conveyed through the secondary transfer station T2 is no less than 1,000, the amount of the reverse bias current is set to 10 μA regardless of the count.

Embodiment 4

Figure 9:
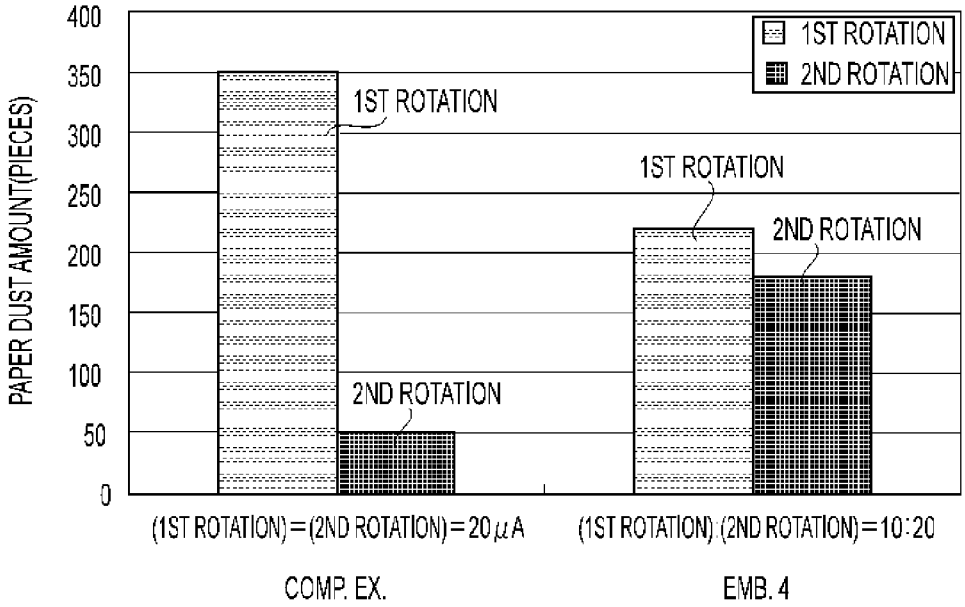
FIG. 9 is a graph showing the amount by which the paper dust is transferred onto the transfer roller during the first full rotation of the transfer roller while reverse bias current is flowed, and that during the second full rotation of the transfer roller.
Figure 10:
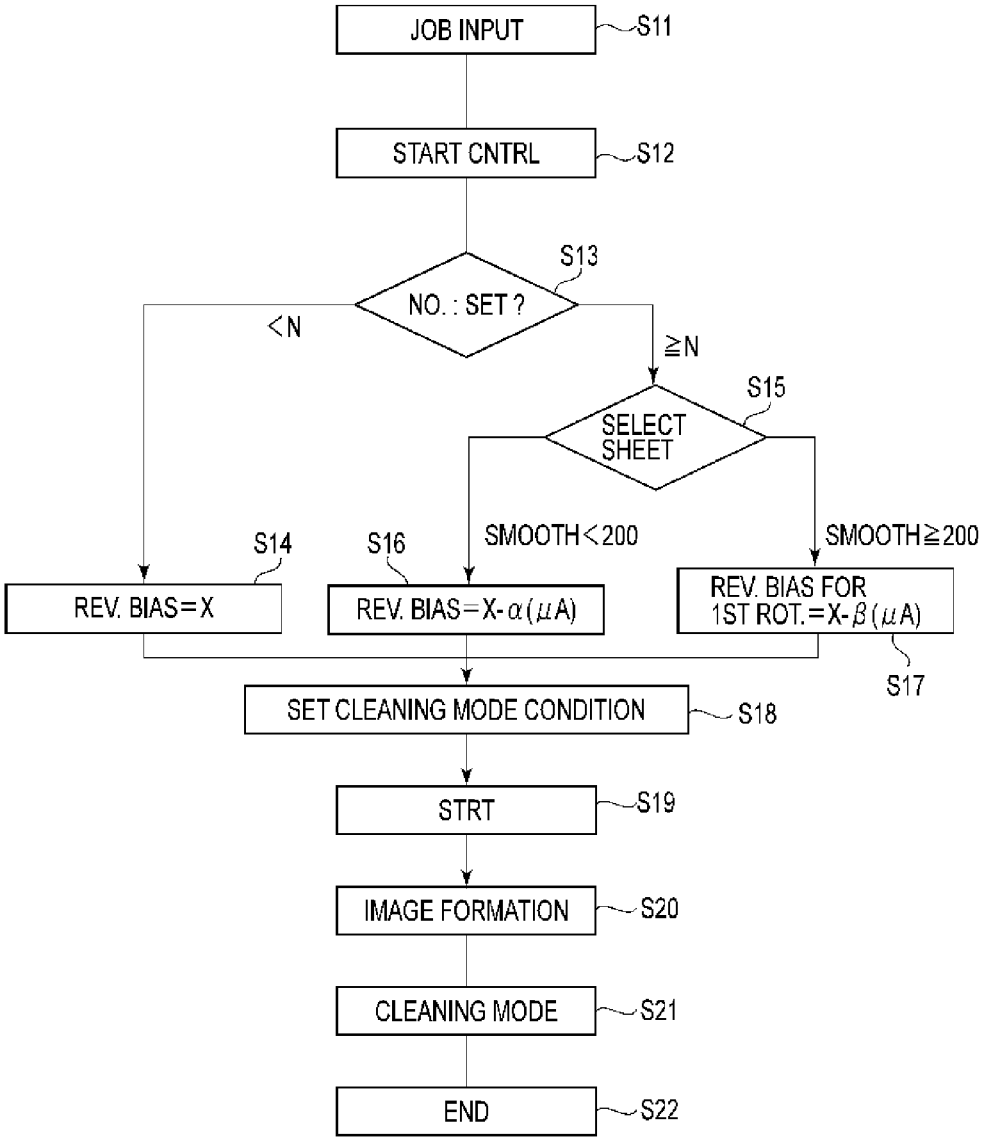
FIG. 10 is a flowchart for the cleaning mode in the fourth embodiment.

FIG. 9 is a drawing for describing the amount by which the paper dust transfers while the reverse bias voltage was flowed during the first full rotation of the secondary transfer roller 24 in the cleaning mode, and the amount by which the paper dust transfer was transferred while the reverse bias voltage was flowed during the second full rotation of the secondary transfer roller 24 in the cleaning mode. FIG. 10 is a flowchart for the cleaning mode in the fourth embodiment. In the fourth embodiment, the reverse bias current is flowed for a length of time equivalent to no less than two full rotations of the secondary transfer roller 24, in order to keep the belt cleaning device 10 as high as possible in belt cleaning performance, while preventing the paper dust from collecting on specific areas of the cleaning edge of the cleaning blade 10*b*.

The extent of the soiling of the back surface of a sheet of recording medium is affected by the degree of smoothness of the sheet of recording medium. The degree of smoothness of a sheet of paper is expressed by the value obtained by measuring the smoothness of the sheet of paper with the use of a Beck smoothness gauge, in accordance with JIS P8119 paper pulp testing method. A sheet of recording medium, which is no less than 200 in smoothness, is more likely to be soiled across its back surface by the toner remaining on the secondary transfer roller 24 than a sheet of recording medium, which is no more than 200 in smoothness.

Referring to FIG. 4, as the cumulative number of the sheets of recording medium which were continuously conveyed through the secondary transfer roller 24 increases, the border portions between the lengthwise center portion of the cleaning blade 10*b* and the lengthwise end portions of the cleaning blade 10*b* become greater in the amount of deformation than the other portions of the cleaning blade 10*b*, and therefore, the paper dust is likely to collect in these portions of the cleaning blade 10*b* in the cleaning mode. Therefore, the reverse bias current cannot be increased.

The smoother the sheet of recording medium, the higher in quality the resultant image. On the other hand, the smoother the sheet of recording medium, the more conspicuous the soiling of the back surface of the sheet. In the cleaning mode, therefore, the smoother the sheet of recording medium, the higher the level at which the toner on the secondary transfer roller 24 is removed must be.

Therefore, in the cleaning mode in this embodiment, the amount of the current which is flowed between the secondary transfer roller 24 and intermediary transfer belt 5 in the direction opposite from the direction in which the current is flowed during the normal image formation process is set inversely proportional to the smoothness of the sheets of recording medium. Also in the cleaning mode in this embodiment, during the first full rotation of the secondary transfer roller 24, the amount of the current which is flowed through the secondary transfer station T2 and is opposite in direction from the current which is flowed through the secondary transfer station T2 during the normal process for transferring toner image, is made smaller than during the second full rotation of the secondary transfer roller 24.

In the cleaning mode in the fourth embodiment, after the positive (normal) bias current is flowed through the secondary transfer station T2 for the length of time which is equivalent to the two full rotations of the secondary transfer roller 24, the reverse bias current is flowed through the secondary transfer station T2 for a length of time which is equivalent to two full rotations of the secondary transfer roller 24. In other words, the total length of time the bias current is flowed through the secondary transfer station T2 is equivalent to four full rotations of the secondary transfer roller 24. The image forming apparatus 100 is operated in the cleaning mode while the cleaning edge of the cleaning blade 10*b* is remaining buckled, after the completion of an image forming operation in which a substantial number of sheets of recording medium are continuously conveyed through the secondary transfer station T2. Increasing the reverse bias current makes it easier for the paper dust to collect between the buckled portions of the cleaning edge and the intermediary transfer belt 5. Thus, both the transfer bias which is normal in polarity and the transfer bias which is reverse in polarity are applied to the secondary transfer roller 24.

The amount by which toner is recovered is proportional to the total amount of electric current flowed by the normal and reversal transfer voltages. Therefore, the increase in the amplitude of the reverse bias current is avoided by extending the length of time the image forming apparatus 100 is operated in the cleaning mode.

Referring to FIG. 9, if both the amount by which the reverse bias current to be flowed during the first full rotation of the secondary transfer roller 24, and the amount by which the reverse bias current flowed during the second full rotation of the secondary transfer roller 24 are the same, it is mostly during the first full rotation of the secondary transfer roller 24 that the transfer of the paper dust from the secondary transfer roller 24 onto the intermediary transfer belt 5 occurs. Comparison between the amount by which the paper dust is expelled during the first full-rotation of the secondary transfer roller 24 and the amount by which the paper dust is excelled during the second full rotation of the secondary transfer roller 24 revealed that when the current flowed during the first full rotation of the secondary transfer roller 24 is greater than the current flowed during the second full rotation of the secondary transfer roller 24, the amount of the paper dust expelled during the first full rotation of the secondary transfer roller 24 is larger than that expelled during the second full-rotation of the secondary transfer roller 24.

Thus, in the fourth embodiment, the reverse bias current to be flowed during the first full rotation of the secondary transfer roller 24 is reduced so that the amount by which the paper dust is transferred is substantially shifted to the second full rotation of the secondary transfer roller 24 and thereafter. If the reverse bias current to be flowed during the first full rotation of the secondary transfer roller 24 is smaller than that during the second full rotation of the secondary transfer roller 24, the amount by which the paper dust is expelled onto the intermediary transfer belt 5 is more or less evenly distributed between the first and second full rotation of the secondary transfer roller 24. In other words, it does not occur that a large amount of paper dust arrives at the cleaning blade 10*b* all at once. Therefore, it is less likely to occur that the paper dust collects between the cleaning edge of the cleaning blade 10*b* and intermediary transfer belt 5.

Further, by setting the amount by which the reverse bias current is to be flowed during the first full rotation of the secondary transfer roller 24, to a value in a range which does not excessively charge the paper dust, and expelling the toner on the secondary transfer roller 24 by the reverse bias applied during the second full rotation of the secondary transfer roller 24 and thereafter, it is possible to prevent the back surface of a sheet of recording medium from being soiled by toner, and also, to prevent the paper dust from collecting between the cleaning edge of the cleaning blade 10*b* and intermediary transfer belt 5, even if the recording medium is smoother than a sheet of ordinary recording paper. As described above, as long as the amount of the contaminants, that is, a mixture of toner and paper dust, on the intermediary transfer belt 5 is not excessive, the contaminants are entirely scraped away by the cleaning blade 10*b*, even if the cleaning edge of the blade 10*b* is buckled. Therefore, it does not occur that a substantial amount of paper dust collects between the cleaning edge and intermediary transfer belt 5.

The cleaning mode in the fourth embodiment was tested by an experiment. In the experiment, after 1,000 sheets of coated paper (128 g in basis weight) were continuously conveyed through the secondary transfer station T2, the aforementioned lubricatory toner belt was formed and transferred onto the intermediary transfer belt 5.

In the experiment, the image forming apparatus 100 was operated in the cleaning mode in the fourth embodiment under the following setup. That is, after the lubricatory toner belt was moved past the secondary transfer roller as shown in FIG. 2, the amount of the normal bias current was kept at 20 μA during both the first and second full rotations of the secondary transfer roller 24. However, the amount of the reverse bias current for the first full rotation of the secondary transfer roller 24 and that for the second full rotation of the secondary transfer roller 24 were set in various combinations. Then, the prints outputted by the image forming apparatus 100 immediately after the completion of the operation of the image forming apparatus 100 in the cleaning mode were examined in order to compare the various combinations, regarding the soiling of the back surface of the prints, and also, the toner on the intermediary transfer belt 5, which slipped by the cleaning blade 10*b*.

TABLE 3

| Reverse bias current (μA) | | | Backside | Paper dust |
|---|---|---|---|---|
| First rotation | Second rotation | Total current | stain prevention | collection prevention |
| 10 | 0 | 10 | NG | G |
| 20 | 0 | 20 | NG | G |
| 30 | 0 | 30 | G | NG |
| 40 | 0 | 40 | G | NG |
| 10 | 10 | 20 | NG | G |
| 10 | 20 | 30 | G | G |
| 10 | 30 | 40 | G | G |
| 20 | 10 | 30 | G | G |
| 20 | 20 | 40 | G | G |
| 20 | 30 | 50 | G | G |
| 30 | 10 | 40 | G | NG |
| 30 | 20 | 50 | G | NG |
| 30 | 30 | 60 | G | NG |

As is evident from Table 3, in order to prevent the back surface of a sheet of recording medium from being soiled by toner, a total of no less than 30 μA of reverse bias current is necessary. However, flowing no less than 30 μA of reverse bias current during the first full rotation of the secondary transfer roller 24 in the cleaning mode makes a substantial amount of the paper dust collect between the cleaning edge of the cleaning blade 10*b* and intermediary transfer belt 5, allowing the toner to slip by the cleaning blade 10*b*. Thus, the continuation of the image forming operation will result in the yielding of prints, the back surface of which suffers from the soiling attributable to the toner which will have slipped by the cleaning blade 10*b*.

On the other hand, when the amount of the reverse bias current to be flowed during the first full rotation of the secondary transfer roller 24 in the cleaning mode was set to 10 μA, and the amount of the reverse bias current to be flowed during the second full rotation of the secondary transfer roller 24 in the cleaning mode was set so that the total amount of the reverse bias current to be flowed in the cleaning mode became no less than 30 μA, no paper dust collected between the cleaning edge of the cleaning blade 10*b* and intermediary transfer belt 5, and none of sheet of recording medium was soiled by the toner.

Referring to FIG. 10 along with FIG. 2, as a command for starting a printing job is inputted (S11), the control section 110 starts up the image forming apparatus 100 (S12). Then, if the number of prints to be made by the job is no more than N (S13), the amount by which the paper dust adheres to the secondary transfer roller 24 is limited, and therefore, the control section 110 sets both the amount by which the reverse bias current is to be flowed during the first full rotation of the secondary transfer roller 24 in the cleaning mode, and the amount by which the reverse bias current is to be flowed during the second full rotation of the secondary transfer roller 24 in the cleaning mode, to X μA (S14).

If the number of prints to be made by the printing job is no less than N, the control section 110 determines the recording sheet type (S15). If the recording paper is very smooth (no less than 200 in smoothness) like coated paper is used for continuously outputting a substantial number of prints (no less than 200 in S15), the control section 110 determines that the secondary transfer roller 24 is to be rotated no less than two full turns in the cleaning mode, and also, sets the amount by which the reverse bias current is to be flowed during the first full rotation of the secondary transfer roller 24 to (X−β) μA (S17).

Further, in order to prevent the problem that the paper dust collects between the cleaning edge of the cleaning blade 10*b* and intermediary transfer belt 5, and allows the toner on the intermediary transfer belt 5 to slip by the cleaning edge of the cleaning blade 10*b*, the control section 110 sets the amount by which the reverse bias current is to be flowed during the first full rotation of the secondary transfer roller 24 in the cleaning mode, and the amount by which the reverse bias current is to be flowed during the second full rotation of the secondary transfer roller 24 in the cleaning mode, so that they satisfy the following mathematical formulas:

(reverse bias current for first rotation)<(reverse bias current for second rotation), (total reverse bias current)=(reverse bias current for first rotation)+(reverse bias current for second rotation).

If the smoothness of the sheets of recording medium is no more than 200 (no more than 200 in S15), and the secondary transfer roller 24 is to be rotated no less than two full turns, the control section 110 sets the amount by which the reverse bias current is to be flowed during the first full rotation of the secondary transfer roller 24, to (X−α) μA (S16). Here, α is smaller than β. In other words, when the sheets of recording medium to be used for the print job are substantially smoother (no less than 200 in S15) than a sheet of ordinary printing paper, the amount by which the reverse bias current is to be flowed during the first full rotation of the secondary transfer roller 24 in the cleaning mode is set greater than when they are sheets of ordinary printing paper.

After setting the image forming apparatus 100 for the cleaning mode (S18), the control section 110 starts the printing job (prints are to be continuously outputted) (S19). After the preset number of prints are outputted (S20), the control section 110 operates the image forming apparatus 100 in the cleaning mode (S21), and stops the image forming apparatus 100 (S22).

Incidentally, in the cleaning mode, each of the normal bias current and reverse bias current may be flowed across several full rotations of the secondary transfer roller 24. Further, the total number of full rotations of the secondary transfer roller 24 in the cleaning mode may be no less than 3. In a case where the image forming apparatus 100 is operated in the cleaning mode while the buckling of the cleaning edge of the cleaning blade 10*b*, which was caused by the continuous conveyance of a substantial sheets of recording medium through the secondary transfer station T2 is left unattended, increasing the reverse bias current makes it easier for the paper dust to collect between the cleaning edge of the cleaning blade 10*b* and intermediary transfer belt 5. In the cleaning mode, therefore, the voltage which is normal in polarity, and the voltage which is reverse in polarity, are applied to the secondary transfer roller 24 across multiple full rotations of the secondary transfer roller 24.

The total amount by which the toner on the intermediary transfer belt 5 is removed is determined by the total amount of the reverse bias current flowed through the secondary transfer station T2. In the fourth embodiment, therefore, the amount by which the reverse bias current is flowed during the first full rotation of the secondary transfer roller 24 is roughly set to a value which does not excessively charge the paper dust, and yet, makes the reverse biases flowed during the second full rotation of the secondary transfer roller 24 and thereafter expel the toner. Therefore, the paper dust is prevented from collecting between the cleaning edge of the cleaning blade 10*b* and intermediary transfer belt 5, and the soiling of the back surface of a sheet of recording medium by the toner can be prevented, even when recording medium which is smoother than the ordinary recording paper is used.

Further, the fourth embodiment can prevent the problem that the back surface of a sheet of recording medium is soiled by toner, and the problem that collecting of the paper dust between the cleaning edge of the cleaning blade 10*b* and intermediary transfer belt 5 allows the toner on the intermediary transfer belt 5 to slip by the cleaning blade 10*b*, while preventing that problem that the secondary transfer roller 24 is reduced in life by the increase in the electrical resistance of the secondary transfer roller 24.

Embodiment 5

The cleaning modes in the first to fourth embodiments can be practiced by an image forming apparatus which transfers a toner image directly from its photosensitive drum(s) onto a sheet of recording medium, and an image forming apparatus which is equipped with a roller which is placed in contact with its photosensitive member to form a transfer station for transferring a toner image onto a sheet of recording medium, and a cleaning blade which is for recovering the toner on the downstream portion of the peripheral surface of the photosensitive member, in terms of the rotational direction of the photosensitive member.

It is possible to make an image forming apparatus operable in the cleaning mode in which the toner on the roller is electrostatically transferred onto the photosensitive member, and is recovered by the abovementioned cleaning blade. Further, under such a condition that the amount by which the paper dust adheres to the roller will be substantial, it is possible to set the amount by which the current which is opposite in direction from the direction in which the current is flowed during the normal secondary transfer of a toner image, inversely proportional to the amount by which the paper dust may adhere to the roller. Further, during the first full rotation of the roller in the cleaning mode, the amount by which the current which is opposite in direction from the direction in which the current is flowed during the normal secondary transfer of a toner image, can be set smaller than the amount by which the current which is opposite in direction from the direction in which the current is flowed during the normal secondary transfer of a toner image is to be flowed during the second full rotation of the roller in the cleaning mode.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 184702/2011 filed Aug. 26, 2011 which is hereby incorporated by reference.

What is claimed is:

1. An image forming apparatus comprising:

a rotatable intermediary transfer member configured to carry a toner image;

an image forming station configured to form a toner image on said intermediary transfer member;

a rotatable transfer roller urged toward said intermediary transfer member to form a transfer portion;

a feeding member configured to feed a recording material to the transfer portion;

a voltage source configured to transfer the toner image from said intermediary transfer member onto the recording material fed from said feeding member by applying a transferring current to said transfer portion;

a cleaning blade, provided downstream of said transfer portion and upstream of said image forming station with respect to a rotational moving direction of said intermediary transfer member, said cleaning blade configured to remove toner deposited on said intermediary transfer member;

an executing portion configured to execute, when said intermediary transfer member and said transfer roller are rotating and the recording material is not present in said transfer portion, an operation in a cleaning mode for removing the toner deposited on said transfer roller to said intermediary transfer member, in which a cleaning current is applied to said transfer portion in a direction opposite to that of the transferring current; and a controller configured to set the cleaning current, wherein upon the execution of the operation in the cleaning mode when a cumulative number of recording materials fed to said transfer portion by said feeding member from a previous execution of the operation in the cleaning mode is a first number or a second number which is smaller than the first number, the controller sets the cleaning current as a first cleaning current if the cumulative number is the first number, and sets the cleaning current as a second cleaning current if the cumulative number is the second number, and wherein the first cleaning current is lower than the second cleaning current.

2. An apparatus according to claim 1, wherein said intermediary transfer member includes an intermediary transfer belt of resin material, and said transfer roller includes an elastic rubber layer, wherein in the cleaning mode, the cleaning current and a current in the same direction as the transferring current are applied to said transfer portion, switching therebetween.

3. An apparatus according to claim 1, wherein said executing portion applies the cleaning current to said transfer portion, during a period when said intermediary transfer member and said transfer roller are rotating and a recording material is not at said transfer portion after a test toner image or a toner band formed on said intermediary transfer member passes through said transfer portion.

4. An apparatus according to claim 3, wherein said executing portion applies a current which is the same direction as the transferring current, and then applies the cleaning current to said transfer portion during the period.

* * * * *